US010697216B2

(12) United States Patent
Ramsauer

(10) Patent No.: US 10,697,216 B2
(45) Date of Patent: Jun. 30, 2020

(54) HINGE SYSTEM

(71) Applicant: Dieter Ramsauer, Schwelm (DE)

(72) Inventor: Dieter Ramsauer, Schwelm (DE)

( * ) Notice: Subject to any disclaimer, the term of this patent is extended or adjusted under 35 U.S.C. 154(b) by 0 days.

(21) Appl. No.: 16/309,615

(22) PCT Filed: Apr. 5, 2017

(86) PCT No.: PCT/EP2017/000415
§ 371 (c)(1),
(2) Date: Dec. 13, 2018

(87) PCT Pub. No.: WO2017/215774
PCT Pub. Date: Dec. 21, 2017

(65) Prior Publication Data

US 2019/0242166 A1 Aug. 8, 2019

(30) Foreign Application Priority Data

Jun. 17, 2016 (DE) ..... 20 2016 003 803

(51) Int. Cl.
*E05D 5/02* (2006.01)
*E05D 5/04* (2006.01)
*E05D 3/02* (2006.01)

(52) U.S. Cl.
CPC ..... *E05D 5/023* (2013.01); *E05D 3/02* (2013.01); *E05D 5/046* (2013.01);
(Continued)

(58) Field of Classification Search
CPC ..... E05D 5/0223; E05D 5/023; E05D 5/0238; E05D 5/046; E05Y 2600/502;
(Continued)

(56) References Cited

U.S. PATENT DOCUMENTS 470,350 A * 3/1892 Nunn ..... E05D 7/04 16/271
864,690 A * 8/1907 Rice ..... E05D 7/12 16/271

(Continued)

FOREIGN PATENT DOCUMENTS

CN 203230283 U 10/2013
CN 204728859 U 10/2015

(Continued)

OTHER PUBLICATIONS

Brochure, "4-247 Hinge Pr01 180°", DIRAK Inc., Jan. 10, 2012.

(Continued)

*Primary Examiner* — Jeffrey O'Brien
(74) *Attorney, Agent, or Firm* — The Webb Law Firm

(57) ABSTRACT

A hinge system is described having at least one first hinge leaf with a single bore, suitable for fixing in an elongated opening or a row of openings in a thin wall, such as a door leaf or door frame of a metal cabinet or housing, wherein the first hinge leaf comes to lie against the margins of the breakthrough or the row of breakthroughs on one side of the thin and with a plate which comes to lie against the margins of the breakthrough or the breakthroughs on the other side of the thin wall, and with a screwed connection which presses together the two surfaces lying on the marginal surfaces, wherein, in the region of the breakthrough, projections extend from the hinge leaf or the plate which extend into or through the breakthroughs, wherein recesses are formed in the plate or the hinge leaf to receive the projections, wherein the projections are guided by the surfaces of the inner edges of the breakthroughs, wherein the threaded bore for the free end of screw passed through a projection provided with a bore.

11 Claims, 5 Drawing Sheets

(52) U.S. Cl.
CPC ..... *E05Y 2600/502* (2013.01); *E05Y 2600/61* (2013.01); *E05Y 2600/626* (2013.01); *E05Y 2800/12* (2013.01); *E05Y 2800/33* (2013.01); *E05Y 2900/208* (2013.01)

(58) Field of Classification Search
CPC ..... E05Y 2900/208; Y10T 16/534; Y10T 16/5345; Y10T 16/554; Y10T 16/5327; Y10T 16/5329
USPC ..... 16/252, 253, 382, 248, 249
See application file for complete search history.

(56) References Cited

U.S. PATENT DOCUMENTS 3,583,736 A * 6/1971 Willimzik ..... E05C 7/06 292/16
4,118,827 A * 10/1978 Yamamoto ..... E05D 5/04 16/252
4,438,597 A * 3/1984 Maggart ..... E05D 7/04 16/242
4,547,930 A * 10/1985 King ..... E05D 5/023 16/247
4,553,286 A * 11/1985 Schwarz, II ..... E05D 5/04 16/222
4,847,947 A * 7/1989 Tsong-Chi ..... E05D 7/0407 16/238
5,079,798 A * 1/1992 Burke ..... E05D 5/0246 16/252
6,038,740 A * 3/2000 Hoger ..... E05D 7/04 16/235
6,178,595 B1 * 1/2001 Marinoni ..... E05D 5/0246 16/252
6,203,231 B1 * 3/2001 Salice ..... E05D 5/0276 403/12
6,286,185 B1 * 9/2001 Ramsauer ..... E05D 7/04 16/236
6,560,821 B2 * 5/2003 Miller ..... E05D 5/0246 16/252
6,648,431 B1 * 11/2003 King ..... E05D 5/046 16/382
6,766,561 B1 * 7/2004 Cheng ..... E05D 5/0246 16/235
7,010,832 B2 * 3/2006 Chen ..... E05D 5/0246 16/235
7,127,775 B2 * 10/2006 Ferre ..... E05D 5/0215 16/223
7,188,390 B2 * 3/2007 Cheng ..... E05D 5/0246 16/235
7,284,740 B2 * 10/2007 Padiak ..... E05D 5/0215 16/309
7,360,279 B2 * 4/2008 Hoffmann ..... E05D 5/023 16/237
7,571,516 B2 * 8/2009 Lueffe ..... E05D 7/0423 16/235
7,594,302 B2 * 9/2009 Balenzano ..... E05D 5/0246 16/252
7,617,567 B2 * 11/2009 Franchini ..... E05D 7/04 16/236
7,900,319 B2 * 3/2011 Bacchetti ..... E05F 3/20 16/252
7,917,994 B2 * 4/2011 Bai ..... E05D 11/105 16/252
8,720,005 B2 * 5/2014 Cheng ..... E05D 5/0246 16/252
8,910,346 B1 * 12/2014 Schafer ..... E05D 7/00 16/247
9,181,739 B2 * 11/2015 Baer ..... E05D 3/122
9,617,754 B2 * 4/2017 Ramsauer ..... E05B 9/08
9,617,771 B2 * 4/2017 Gill ..... E04G 5/14
2008/0083086 A1 * 4/2008 Lin ..... E05D 5/0246 16/252
2008/0168621 A1 * 7/2008 Lin ..... E05D 11/1064 16/252
2009/0188082 A1 * 7/2009 Huang ..... E05D 5/0246 16/382
2014/0150345 A1 * 6/2014 Price ..... E05D 3/022 49/381

FOREIGN PATENT DOCUMENTS

DE 4103842 A1 8/1991
DE 29710853 U1 11/1998
EP 0466289 A1 1/1992
EP 1001124 A1 5/2000
WO 2013005055 A1 1/2013

OTHER PUBLICATIONS

Brochure, "4-271 Hinge Pr01 270°", DIRAK Inc., Jan. 10, 2012.
Office Action for Chinese Patent Application No. 201780037750.8 dated Nov. 4, 2019.

* cited by examiner 220
226
216
210
260
10
218
224
222
69
228
258

210
222
260

210
222
228
258
62
222

254
234
210
230
241
234
243
214
245
235
237
239
250

70
234
236
218
69

70
245
237
250
222
69
62

210
220
264
234
236
226
260
238

220
210
266
260

220
210
265
62
261
62

220
210
267
261

HINGE SYSTEM

CROSS-REFERENCE TO RELATED APPLICATIONS

This application is the United States national phase of International Application No. PCT/EP2017/000415 filed Apr. 5, 2017, and claims priority to German Patent Application No. 20 2016 003 803.7 filed Jun. 17, 2016, the disclosures of which are hereby incorporated in their entirety by reference.

BACKGROUND OF INVENTION

Field of the Invention

The invention relates to a hinge system having at least one first hinge leaf with a single bore, suitable for fixing in an elongated opening or in several openings arranged in a row in a thin wall, such as a door leaf or door frame of a metal cabinet, wherein the hinge leaf comes to lie against the margins of the breakthrough or the breakthroughs on one side of the thin wall, and with a plate which comes to lie against the margins of the breakthrough or the breakthroughs on the other side of the thin wall, and with a screwed connection which presses together the two surfaces lying on the marginal surfaces, wherein, in the region of the breakthrough, projections extend from the hinge leaf or the plate which extend into or through the breakthroughs, wherein recesses are formed in the plate or the hinge leaf to receive the projections, wherein the projections are guided by the surfaces of the inner edges of the breakthroughs.

Description of Related Arts

Such a hinge system is already known from the brochure 4-247 Scharnier PrO1 180°, published by DIRAK GmbH, Königsfelder Str. 1, 58256 Ennepetal. Fixing by means of a screw has the advantage of simplifying installation, but requires a means of securing against rotation which is otherwise realised by means of a second fixing screw, as for example according to the brochure 4-271 Scharnier, justierbar PrO1 270°. In order to guarantee the fixing of the hinge leaves to the door leaf or the door frame, it is usual to provide the hinge with in each case two cast threaded pins, which is expensive.

SUMMARY OF THE INVENTION

It is the object of the invention to achieve the necessary security against rotation without the use of a second screw. At the same time, an adequate stability should be guaranteed, so that a single screw is sufficient to guarantee a secure and economical fixing, whether from inside or outside.

The object of the invention is achieved in that the bore for the free end of the screw is passed through a projection.

The result of this is that the region of the bore for the screw is reinforced, so that greater stability is achieved, and moreover security against rotation is already achieved because the breakthrough is not round but elongated or consists of breakthroughs arranged in a row.

According to a further development of the invention, the hinge system possesses a second leaf which is connected with the first leaf by means of a hinge-pin arrangement and which also requires only one screw.

According to yet a further embodiment, the hinge system is characterised in that the bore for the head end of the screw is passed through the conical recess for a countersunk screw head.

The bore for the end of the screw can be formed in a tubular section which is reinforced through optional sloping partition walls.

The surfaces lying against the marginal surfaces can include grooves for O-ring seals, or the projection can include a screw thread for the screw.

The other projections can provide bridges between the two longitudinal edges of the breakthroughs.

The side surfaces of the projections can in turn form grooves for an O-ring seal.

In order to achieve axial adjustability it is favourable if the openings or the row of openings permit an axial displacement of the projections on the plate or the leaf projecting into them.

The hinge system can also be characterised in that the second hinge leaf is analogous or complementary in structure to the first hinge leaf.

It is also conceivable that one of the screws is arranged with its head on the inner side or the outer side of the door.

The projections or recesses arranged at the ends of the longitudinal extension of the rectangular breakthroughs can be arranged at a distance from the narrow rectangular edge for the purpose of axial adjustment (axially in the direction of the longer side of the rectangle or the row of breakthroughs).

In order to achieve axial and radial adjustability, one leaf can have a radial orientation of the rectangle and the other leaf an axial orientation.

BRIEF DESCRIPTION OF THE DRAWINGS

The invention is explained in more detail in the following with reference to exemplary embodiments which are represented in the drawings. wherein.

DESCRIPTION OF THE INVENTION

Figure 1A:
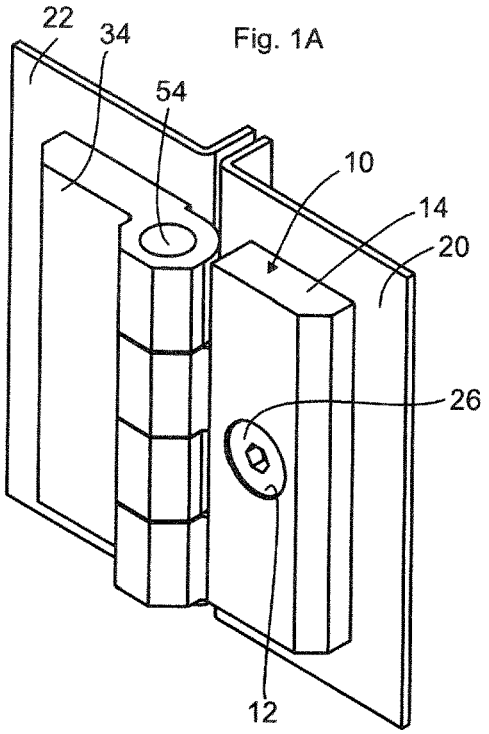
FIG. 1A shows a top view, from outside, of a hinge according to the invention, according to a first embodiment, mounted on a cabinet, in a mounted perspective representation.
Figure 1B:
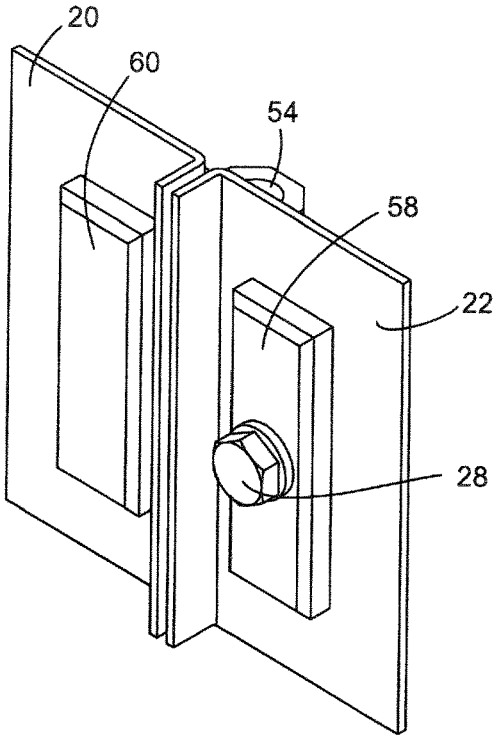
FIG. 1B shows a rear view of the hinge from FIG. 1A.
Figure 1C:
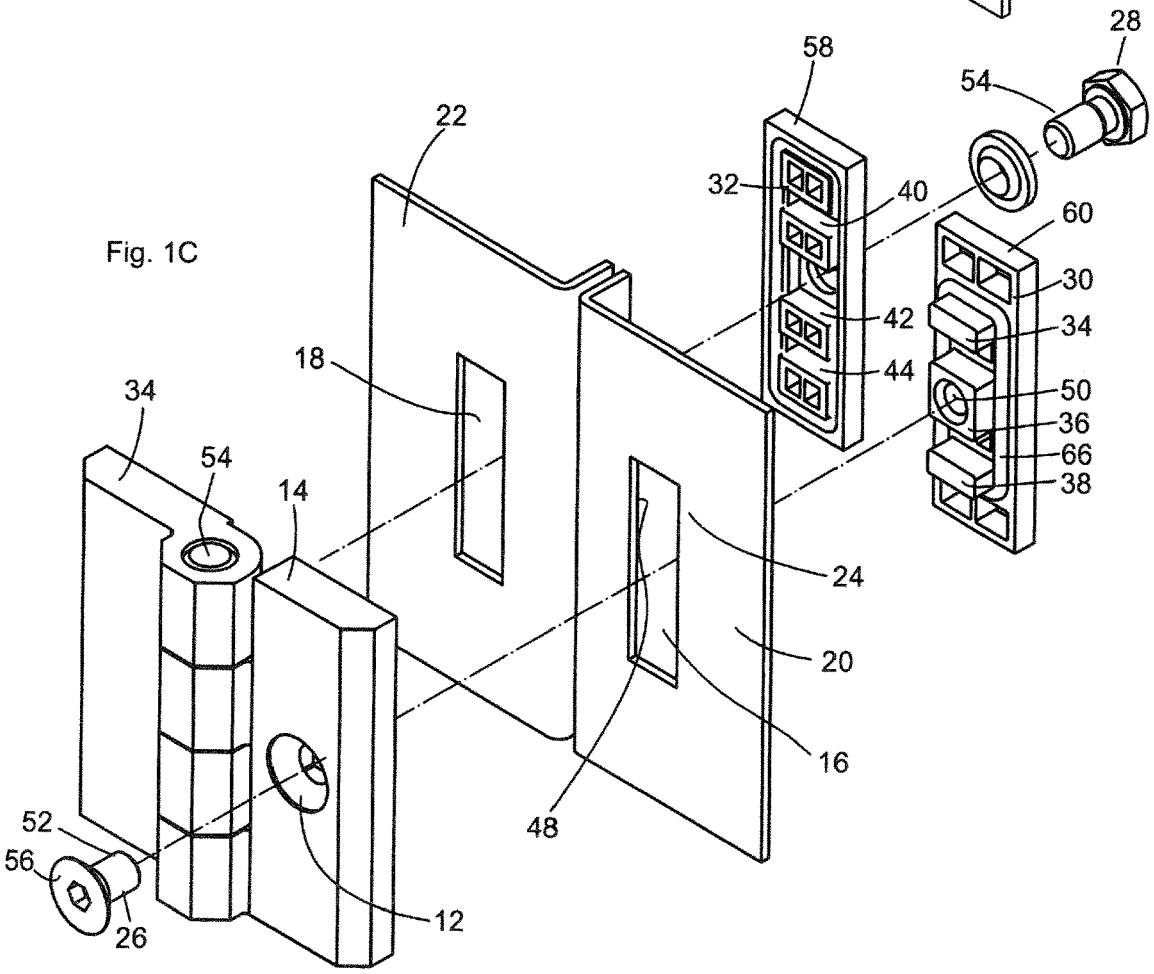
FIG. 1C shows a pulled-apart representation of the hinge according to FIG. 1A.
Figure 3A:
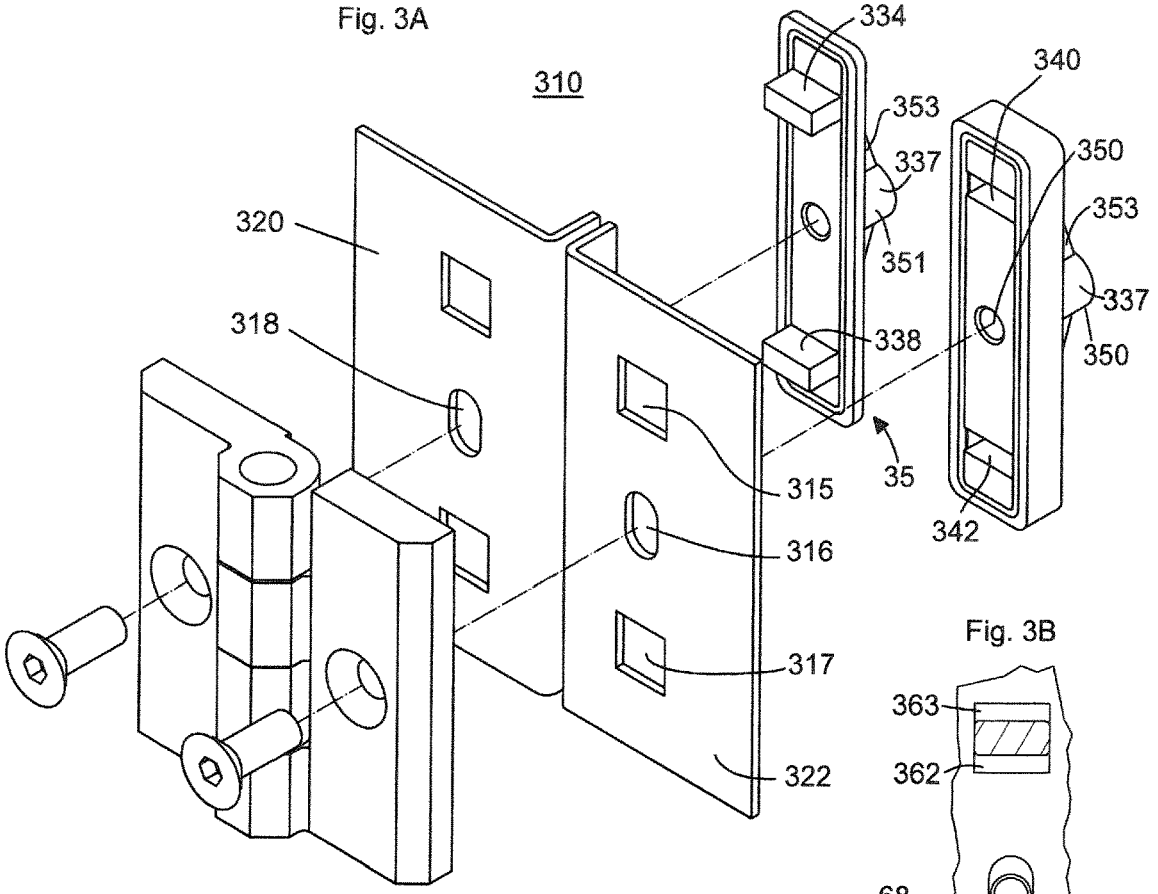
FIG. 3A shows a further embodiment of the hinge according to the invention in a pulled-apart representation.
Figure 3B:
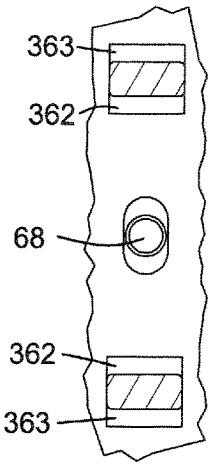
FIG. 3B shows a sectional view along the contact surface of the leaf provided with projections.
Figure 3C:
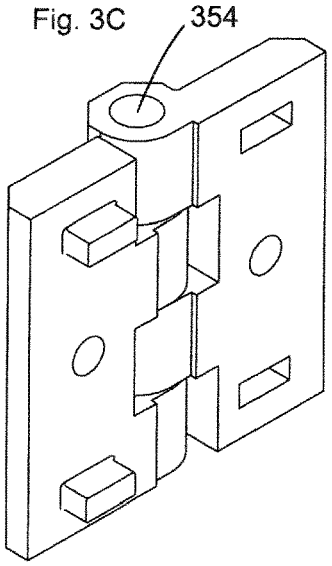
FIG. 3C shows a representation of the opened unmounted hinge.
Figure 3D:
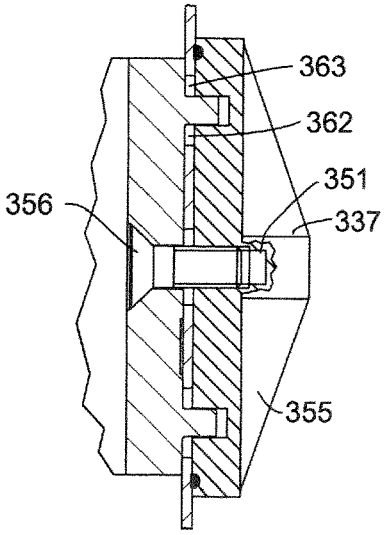
FIG. 3D shows a representation of the opened unmounted hinge.
Figure 4A:
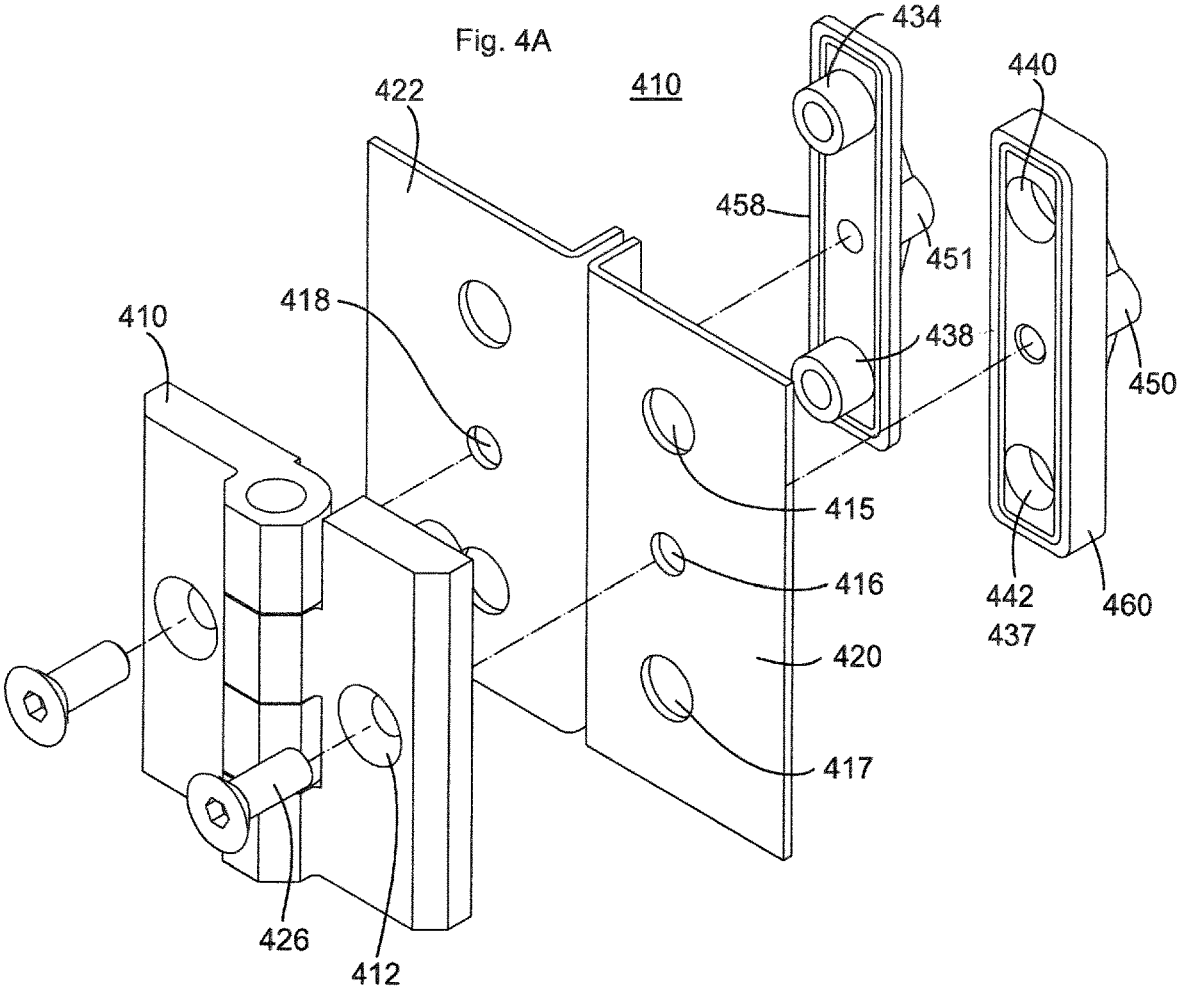
FIG. 4A shows a further embodiment of the hinge according to the invention in a pulled-apart representation.
Figure 5A:
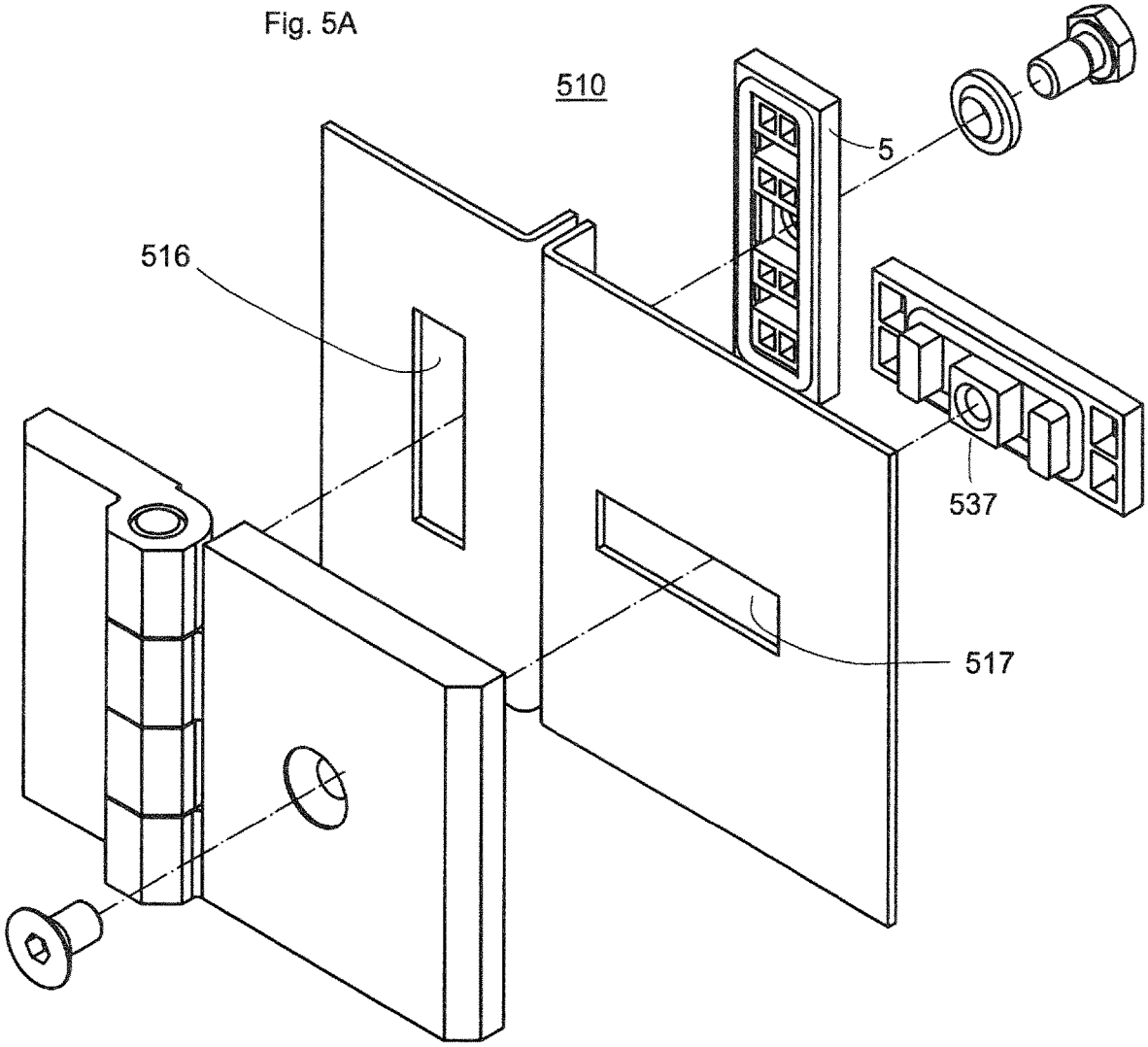
FIG. 5A shows an application of the hinge according to the invention with the possibility of adjustment in two dimensions.

FIG. 1A shows a hinge system 10 viewed obliquely from the outside, consisting of a hinge leaf 14 with a bore 12, said hinge system being suitable for fixing in an elongated opening 16, see the pulled-apart representation of the hinge according to FIG. 1C, or alternatively in several openings arranged in a row, see reference numbers 316, 315, 317 in FIG. 3A, reference numbers 416, 415, 417 in FIG. 4A and reference numbers 517, 516 in FIG. 5A. The opening 16 in the thin wall 20 has marginal surfaces 24 against which the hinge leaves of the hinge 10 breakthrough come to lie. The two retaining surfaces 30, 32 lying against the marginal surfaces 24 are pressed together by means of a screwed connection 26 or 28, wherein projections 34, 36, 38 extend from the hinge leaves 14, 34 or the plate 30, 32 in the region of the breakthrough 16 or 18 which extend into or through the breakthroughs 16, wherein recesses 40, 42, 44 are formed in the plate or the hinge leaves 14, 32 to receive the projections 34, 36, 38, wherein the projections are guided by the surfaces 48 of the inner edges 48 of the breakthroughs 16, 18.

In particular and according to the invention, the bore 50 is passed through a projection 36 beyond the free end of the screw 26.

The embodiment shown in FIG. 1A to 1C also includes a second leaf 34 which is connected with the first leaf 14 in an articulated manner by means of a hinge pin 54.

The hinge system can be characterised in that the bore 12 for the head end 56 of the screw 26 is passed through the conical recess for a countersunk screw head.

Figure 3E:
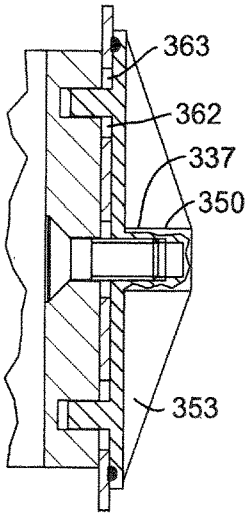
FIG. 3E shows a corresponding representation of the other leaf.

The bore 50 provided with a thread 68 for the free end 26 of the screw can be formed in a tubular section 51, see FIG. 3E, which is reinforced through optional sloping partition walls 353, see FIG. 3A to 3E. The tubular section 353 or 350 thus contains a screw thread.

The projection 36 also contains a threaded bore 50.

Figures 2A, 2B, 2C, 2D, 2E, 2F, 2G, 2H, 2I, 2J:
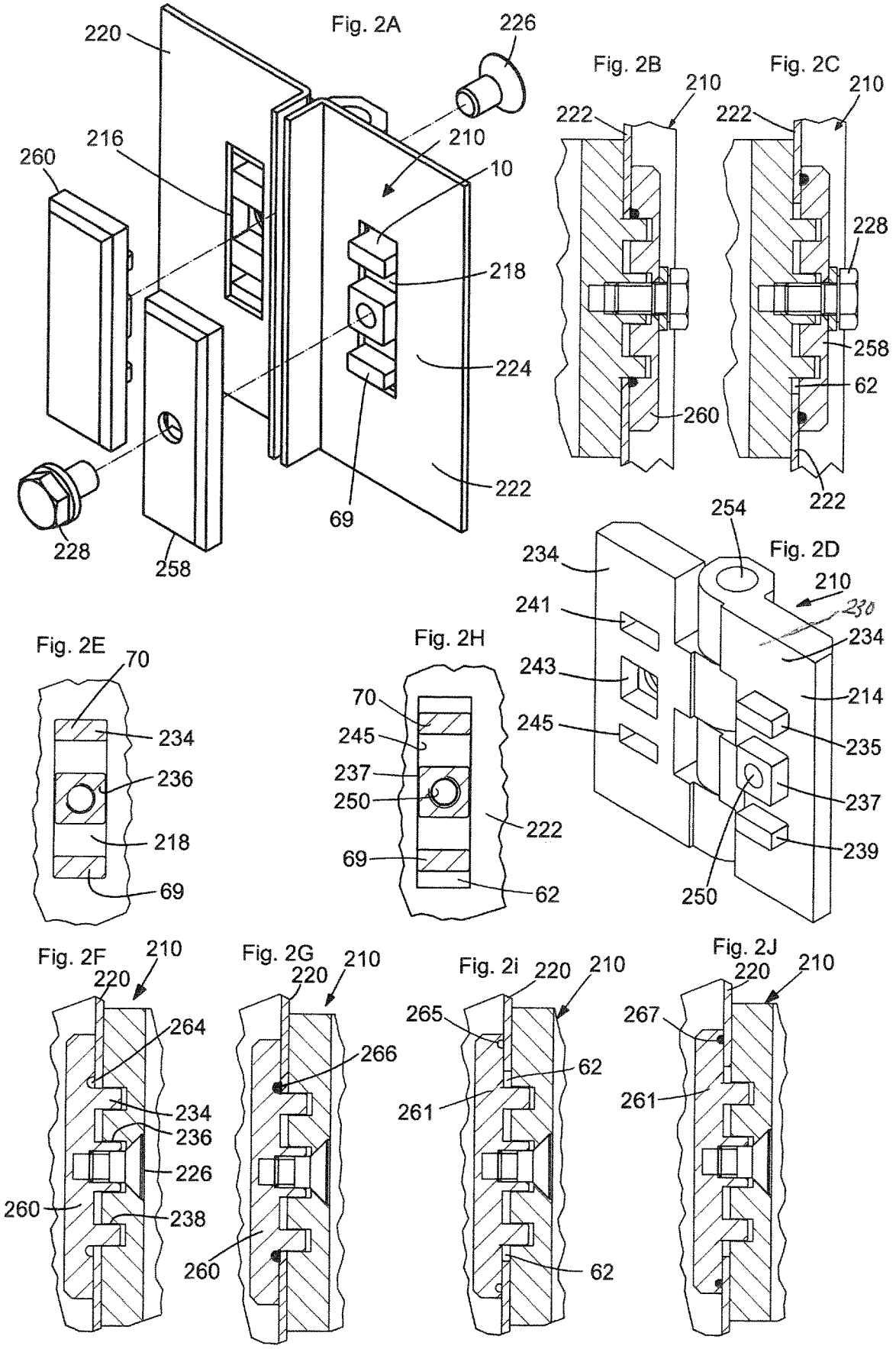
FIG. 2A shows another embodiment of the hinge according to the invention in a pulled-apart representation.
FIG. 2B shows the hinge from FIG. 2A in a sectional view illustrating the use of an O-ring seal.
FIG. 2C shows a similar embodiment with different arrangement of an O-ring seal.
FIG. 2D shows the unmounted hinge, opened up.
FIG. 2E shows a sectional view along the contact plane of one hinge part.
FIG. 2F shows an axial sectional view through one fixing possibility by means of a countersunk screw.
FIG. 2G shows a similar representation to FIG. 2F, but with inserted O-ring seal.
FIG. 2H shows a sectional view along the contact plane of the further embodiment.
FIG. 2I shows an axial sectional view illustrating the adjustability in an axial direction.
FIG. 2J shows the embodiment according to FIG. 2I, but with O-ring seal.

As can be seen from FIG. 1C as well as FIGS. 2E and 2H, and as can also be seen from FIG. 2A, the other projections, e.g. 234 in FIG. 2E, form bridges 69, 70 between the two longitudinal edges 248 of the breakthrough 218.

FIGS. 2E, 2F and 2G show that the side surfaces of the projections 69, 70, 276 also form grooves 264 for an O-ring seal 266.

In order to achieve axial adjustability, the rectangular breakthrough permit an axial displacement of the plate 260 and thus the projections on the plate relative to the hinge leaves, see reference numbers 62, 362.

The hinge system can be designed such that the second hinge leaf 34 is analogous or complementary in structure to the first hinge leaf 14.

FIGS. 1A, 1C and 2A for example show complementary hinge leaves 14, 34, 214, 334, whereas FIG. 3A for example shows an analogous arrangement.

FIG. 4A also shows a complementary arrangement in which, however, the arrangement of the screws 426 is analogous for the two leaves.

Figure 4B:
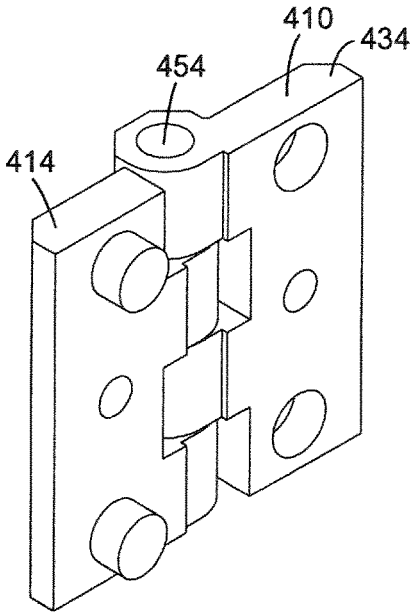
FIG. 4B shows a representation of the unmounted hinge in opened position.
Figure 4C:
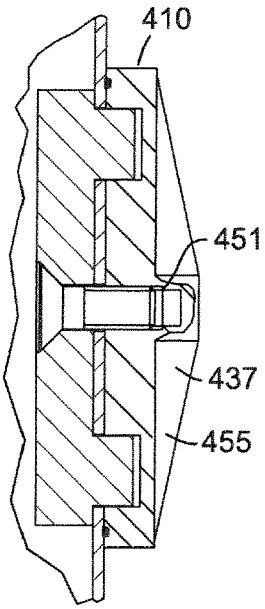
FIG. 4C shows an axial representation of the section through one leaf.
Figure 4D:
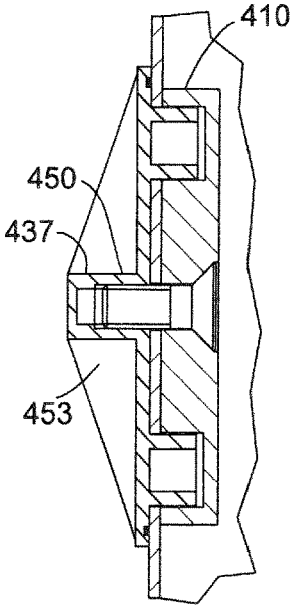
FIG. 4D shows a corresponding representation through the other leaf.

The further FIGS. 4C and 4D show, as a particularly favourable embodiment, that one screw 426 is arranged with its hexagonal screw head 428 on the outer side of the door, whereas FIG. 4B, 4C and FIG. 4D show a different arrangement.

It serves the purpose of axial adjustability if the projections 334, 338 or recesses 340, 342 arranged at the ends of the longitudinal extension of the rectangular breakthroughs are arranged at a distance 362 from the narrow rectangular edge.

In order to achieve axial and radial adjustability it is favourable if one leaf has a radial orientation of the longitudinal extension of the rectangular breakthrough and the other leaf has an axial orientation.

The projecting dog point of the fixing screw is square or rectangular in design and in the case of thicker metal doors penetrates into the bridge mounted at the back in order to provide security against rotation, even if the projecting outer extensions are shorter and do not reach the inner bridge.

INDUSTRIAL APPLICATION

The invention can be applied commercially in the construction of switchgear cabinets.

LIST OF REFERENCE NUMERALS

10, 110, 210, 310, 410, 510 Hinge system
12, 112, 212, 312, 412, 512 Bore
14, 114, 214, 414, 514 Hinge leaf (first with through-bore)
315 Opening
16, 216, 316, 416, 516 Opening
517 Opening
18, 218, 318, 418, 518 Opening
20, 220, 320, 420 Thin wall, door leaf
22, 222, 322, 422 Thin wall, door frame
24, 224 Marginal surface
26, 226, 426 Screwed connection, end of screw, screw
28, 228, 428 Screwed connection
30 Retaining surface
32 Retaining surface
34, 234, 434 Hinge leaf (second) (with threaded bore)
235 Projection
36, 236 Projection
237, 337, 437, 537 Projection
38, 438 Projection
239 Projection
40, 440 Projection
241 Recess
42, 442 Recess
243 Recess
44 Recess
245 Recess
46 Recess
48, 248 Inside edge of opening, edges
50, 250 Bore

51, 451 Tubular section
52 Free end
353 Partition wall
54, 254, 454 Hinge pin
355, 455 Partition wall
56 Head end
58, 258, 458 Retaining plate (with through-bore)
60, 260, 460 Retaining plate (with threaded bore)
261 Retaining plate
62, 362 Breakthrough extension, play
63,363 Breakthrough extension, play
264 Groove
265 Groove
66, 266 O-ring seal
267 O-ring seal
68 Thread
69 Bridge
70 Bridge

The invention claimed is:

1. A hinge system comprising:

a first hinge leaf, a second hinge leaf pivotably connected to the first hinge leaf by a hinge pin, and a first plate, the first hinge leaf comprises a single countersunk bore, wherein the first hinge leaf is configured for fixing in an elongated breakthrough or a row of breakthroughs in a thin wall, the first hinge leaf comprises a first surface configured to abut margins of each breakthrough on a first side of the thin wall, the first plate comprises a second surface configured to abut margins of each breakthrough on a second side of the thin wall, and a screwed connection presses together the first and second surfaces to abut the margins of each breakthrough, one of the first hinge leaf and the first plate comprises first projections and a second projection extending from the first hinge leaf or the first plate into or through each breakthrough, the other of the first hinge leaf and the first plate comprises recesses formed in the first plate or the first hinge leaf to receive the first and second projections, wherein the first projections are guided by surfaces of inner edges of each breakthrough, wherein the screwed connection comprises:

a screw having a conical countersunk head and a threaded free end, and a reinforced tubular threaded bore extending through the second projection, wherein the threaded free end of the screw extends through the single countersunk bore of the first hinge leaf, the breakthrough or one breakthrough of the row of breakthroughs, and the threaded bore of the second projection to threadedly connect the first hinge leaf and the first plate.

2. The hinge system according to claim 1, wherein the first and second surfaces abutting the marginal surfaces have grooves for ring seals.

3. The hinge system according to claim 1, wherein the first and second projections form a plurality of bridges between two longitudinal edges of each breakthrough.

4. The hinge system according to claim 1, wherein side surfaces of the second projection forms a groove for an O-ring seal.

5. The hinge system according to claim 1, wherein each breakthrough is longer than the respective first and second projections in a direction parallel to the hinge pin to permit an axial displacement of the first and second projections with respect to the breakthrough or row of breakthroughs.

6. The hinge system according to claim 1, wherein the second hinge leaf is similar in structure to the first hinge leaf.

7. The hinge system according to claim 1, wherein the screw is arranged with its head on an inner side or an outer side of the thin wall.

8. The hinge system according to claim 1, wherein each breakthrough is rectangular.

9. The hinge system according to claim 1, wherein the first hinge leaf extends parallel to the hinge pin and the second hinge leaf extends perpendicular to the hinge pin.

10. The hinge system according to claim 1, wherein the thin wall is comprised of one of a door leaf, a door frame of a metal cabinet and a housing.

11. The hinge system according to claim 1, wherein the tubular section is reinforced through sloping partition walls.

* * * * *